US010822816B2

(12) United States Patent
Coughlan

(10) Patent No.: US 10,822,816 B2
(45) Date of Patent: Nov. 3, 2020

(54) CONCRETING TOOLS

(71) Applicant: RHINO FLOATS PTY LTD, Brisbane (AU)

(72) Inventor: Michael Joseph Coughlan, Brisbane (AU)

(73) Assignee: RHINO FLOATS PTY LTD, Queensland (AU)

( * ) Notice: Subject to any disclaimer, the term of this patent is extended or adjusted under 35 U.S.C. 154(b) by 0 days.

(21) Appl. No.: 16/340,886

(22) PCT Filed: Oct. 12, 2017

(86) PCT No.: PCT/AU2017/051103
§ 371 (c)(1),
(2) Date: Apr. 10, 2019

(87) PCT Pub. No.: WO2018/068091
PCT Pub. Date: Apr. 19, 2018

(65) Prior Publication Data

US 2019/0234084 A1 Aug. 1, 2019

(30) Foreign Application Priority Data

Oct. 12, 2016 (AU) ..... 2016904132

(51) Int. Cl.

| | |
|---|---|
| ***E04F 21/00*** | (2006.01) |
| ***E04F 21/24*** | (2006.01) |
| ***E01C 19/40*** | (2006.01) |
| ***E04G 21/10*** | (2006.01) |
| ***E04G 21/08*** | (2006.01) |
| ***E01C 19/48*** | (2006.01) |

(52) U.S. Cl.
CPC ..... *E04F 21/242* (2013.01); *E01C 19/402* (2013.01); *E01C 19/484* (2013.01); *E04F 21/248* (2013.01); *E04G 21/08* (2013.01); *E04G 21/10* (2013.01)

(58) Field of Classification Search
CPC .... E04F 21/242; E04F 21/248; E01C 19/402; E01C 19/484; E04G 21/08; E04G 21/10
USPC ..... 404/73, 84.05, 112, 113
See application file for complete search history.

(56) References Cited

U.S. PATENT DOCUMENTS 5,632,570 A * 5/1997 Balling ..... E04F 21/248 404/112
5,962,951 A 10/1999 Bishop
6,139,217 A 10/2000 Reuter
(Continued)

FOREIGN PATENT DOCUMENTS

FR 1289210 A 3/1962

OTHER PUBLICATIONS

International Search Report and Written Opinion dated Nov. 15, 2017 for Application No. PCT/AU2017/051103.
(Continued)

*Primary Examiner* — Raymond W Addie
(74) *Attorney, Agent, or Firm* — Patterson + Sheridan, LLP

(57) ABSTRACT

A vibrating float including an elongate plate, having a substantially planar lower surface configured to be moved across the concrete; a plurality of evenly spaced electric motors coupled to the elongate plate and configured to vibrate the plate; and a handle, coupled to the elongate plate, for use by an operator to control movement of the vibrating float.

14 Claims, 7 Drawing Sheets

(56) References Cited

U.S. PATENT DOCUMENTS

| | | | | |
|---|---|---|---|---|
| 6,264,397 | B1 * | 7/2001 | Majewski | E04F 21/248 404/112 |
| 6,780,369 | B1 | 8/2004 | Darrow et al. | |
| 7,293,938 | B1 * | 11/2007 | Suckow | E01C 19/402 404/114 |
| 2005/0036837 | A1 | 2/2005 | Marshall | |
| 2005/0254897 | A1 | 11/2005 | Ewer et al. | |
| 2006/0083589 | A1 * | 4/2006 | McClain | B24B 7/18 404/112 |
| 2006/0204336 | A1 * | 9/2006 | Masterson | E04F 21/248 404/112 |
| 2007/0071553 | A1 * | 3/2007 | Koba | E04F 21/244 404/112 |
| 2012/0183351 | A1 | 7/2012 | Brening | |

OTHER PUBLICATIONS

Search Report for related European application 178596.8 dated Apr. 30, 2020.

* cited by examiner

CONCRETING TOOLS

TECHNICAL FIELD

The present invention relates to tools for concreting. In particular, although not exclusively, the present invention relates to tools for concreting small areas.

BACKGROUND ART

Traditionally, concreting has been a labour intensive job, where levelling and finishing of concrete is often performed by hand. Levelling and finishing concrete by hand places stress on the lower body, knees, and back, which can result in injuries, particularly in the long term.

Furthermore, concreting must be completed in a timely manner, to prevent the concrete from becoming "cold" and unworkable. As such, in many cases a worker may rush concreting work, to avoid having the concrete go bad. This may in turn increase the stress on the body, and thus increase the likelihood of injury.

Several machines have been developed to assist workers in levelling and finishing concrete. Vibrating levellers (power screeds) exist, which comprise a combustion engine positioned on an elongate blade, which is configured to level out and vibrate wet concrete. Similarly, power trowels (power floats) exist, which comprise a combustion engine coupled to a set of rotating blades which are configured to smooth partially cured concrete.

Vibrating levellers and power trowels are generally good for large areas, such as house slabs, as they allow a worker to efficiently move work across the large area. These power tools are, however, generally not suited to small areas, or for use by a sole concreter or a do-it-yourself handyman, due to their large size and weight. In particular, these power tools generally require at least two people to lift, and are specifically configured to work over large areas.

As such, there is clearly a need for improved tools for concreting.

It will be clearly understood that, if a prior art publication is referred to herein, this reference does not constitute an admission that the publication forms part of the common general knowledge in the art in Australia or in any other country.

SUMMARY OF INVENTION

The present invention is directed to concreting tools, which may at least partially overcome at least one of the abovementioned disadvantages or provide the consumer with a useful or commercial choice.

With the foregoing in view, the present invention in one form, resides broadly in a vibrating float for levelling concrete, the vibrating float comprising:

an elongate plate, having a substantially planar lower surface configured to be moved across the concrete;

at least one electric motor coupled to the elongate plate and configured to vibrate the plate; and a handle, coupled to the elongate plate, for use by an operator to control movement of the vibrating float.

Advantageously, the vibrating float is lighter than prior art floats which include internal combustion engines, and thus easier to transport and safer to use.

Preferably, the vibrating float includes a rechargeable battery, coupled to the electric motor, configured to power the electric motor. Suitably, the rechargeable battery is removable from the vibrating float for charging. This enables multiple batteries to be used with the vibrating float, thus avoiding down time due to recharging.

Preferably, the vibrating float includes a plurality of electric motors, along a length of the elongate plate. As such, the electric motors may provide a more uniform vibration that from a single motor.

Preferably, the vibrating float includes a plurality of motors along a front edge of the elongate plate, and a plurality of motors along a rear edge of the elongate plate. Alternatively, the vibrating float may include a plurality of motors centrally positioned along the length of the elongate plate.

Preferably, the vibrating float includes an elongate body, housing the plurality of motors, wherein the elongate plate comprises a lower surface of the elongate body.

Preferably, the elongate body includes a slanted surface facing forwards, and a substantially vertical wall facing rearwards.

Preferably, the elongate plate is separable from the rest of the body and may comprise durable plastic.

Preferably, the handle comprises a pair of handles that extend upwardly from the elongate plate. Suitably, in use, ends of the handles are at about waist height.

Preferably, the handle includes a throttle enabling the user to control a speed of the motor, and thus a frequency of vibration.

Preferably, the vibrating float includes a control panel, to enables an operator to adjust a speed or frequency of the vibrating float.

Preferably the vibrating float includes an elongate chassis received within the elongate body, the plurality of motors coupled to the elongate chassis.

The elongate body and chassis may be uniform in cross section.

The elongate body may be configured to receive end caps to retain the chassis therein.

One or more spacers may extend between the pair of handles.

The handle may extends upwardly in a direction perpendicular to the lower surface of the elongate plate, then backwards. The handle may be adjustable in height.

The elongate body may include a slanted surface facing forwards, and a substantially vertical wall facing rearwards.

In another form, the invention resides broadly in a rotary trowel for finishing concrete, the rotary trowel comprising:

a blade, having a substantially planar lower surface configured to be moved across the concrete;

an electric motor coupled to the blade and configured to rotate the blade; and a handle, coupled to the blade, for use by an operator to control movement of the rotary trowel.

Advantageously, the rotary trowel is lighter than prior art floats which include internal combustion engines, and thus easier to transport and safer to use.

Preferably, the rotary trowel includes a rechargeable battery, coupled to the electric motor, configured to power the electric motor. Suitably, the rechargeable battery is removable from the rotary trowel for charging. This enables multiple batteries to be used with the rotary trowel, thus avoiding down time due to recharging.

Preferably, the electric motor is located above the rotary trowel.

Preferably, the blade is separable from the rest of the body and may comprise durable plastic.

Preferably, a height of the handle is adjustable. Suitably, the handle includes a pivot hinge. Preferably, in use, ends of the handles are at about waist height.

Preferably, the handle includes a throttle enabling the user to control a speed of the motor, and thus a speed of the blade.

Preferably, the handle is releasably engagable with the body.

Preferably, the rotary trowel includes a second handle, for lifting the rotary trowel. Suitably, the handle and the second handle are coupled to a common handle assembly.

Preferably, the rotary trowel includes a control panel, to enables an operator to adjust a speed of the rotary trowel.

Preferably, the blade is kidney-shaped. Preferably, the blade is curved upwards at leading edges.

Preferably, a safety shield is provided above the blade.

In another form, the present invention resides broadly in a concreting tool including a plate, configured to moved across a surface of concrete, including an electric motor coupled to the blade or plate and configured to move the blade or plate relative to the concrete, and a rechargeable battery, coupled to, and for powering, the motor.

Any of the features described herein can be combined in any combination with any one or more of the other features described herein within the scope of the invention.

The reference to any prior art in this specification is not, and should not be taken as an acknowledgement or any form of suggestion that the prior art forms part of the common general knowledge.

BRIEF DESCRIPTION OF DRAWINGS

Various embodiments of the invention will be described with reference to the following drawings, in which.

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way.

DESCRIPTION OF EMBODIMENTS

Figure 1:
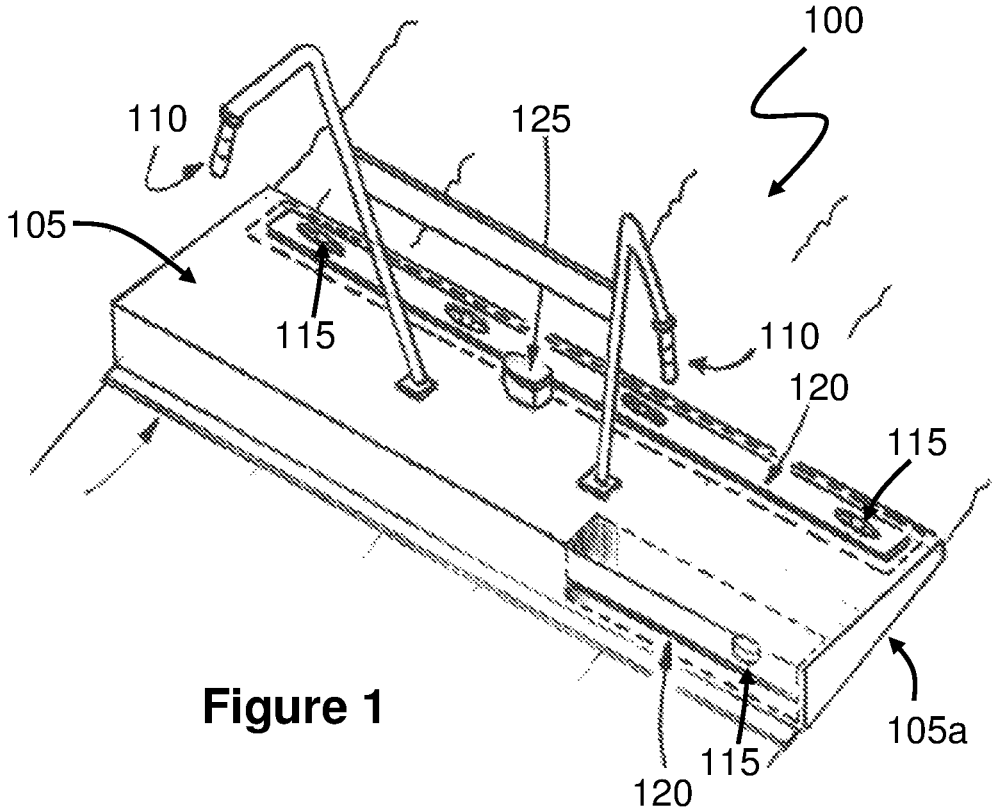
FIG. 1 illustrates a rear perspective view of a vibrating float, according to an embodiment of the present invention.
Figure 2:
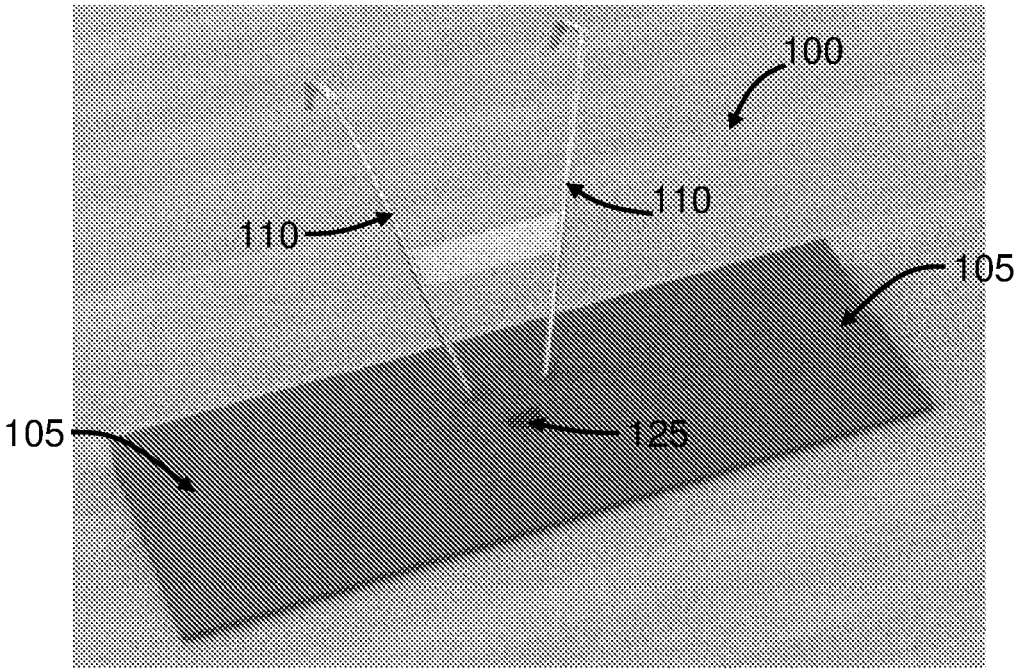
FIG. 2 illustrates a front perspective view of the float of FIG. 1.

FIG. 1 illustrates a rear perspective view of a vibrating float 100, according to an embodiment of the present invention, and FIG. 2 illustrates a front perspective view of the float 100. The vibrating float 100 is ergonomic, and provides a safe and convenient way to level concrete while standing, which prevents stress and injury to the lower body, knees and back. Furthermore, the vibrating float 100 is lightweight, and can thus can be safely moved and transported by a single person.

The vibrating float 100 includes an elongate body 105, from which a pair of handles 110 upwardly extend. In use, ends of the handles 110 are at about waist height and are configured to allow a user to manipulate the vibrating float 100 across a bed of concrete to level the concrete, while retaining an ergonomic posture.

The body 105 defines a housing, which, as best illustrated in FIG. 1, houses a plurality of electric motors 115. The electric motors 115 are coupled to front and rear vibrating plates 120, which are in turn coupled to, and configured to vibrate a lower surface 105*a* of the body.

The vibrating plates 120 extend substantially across an entire length of the elongate body 105, and the electric motors 115 are placed along a length of each of the vibrating plates 120. Such configuration provides vibration along an entire length of the body 105 with relatively small motors 115.

In the vibrating float 100, four vibrating motors 115 are evenly spaced along the lengths of each of the vibrating plates 120, but the skilled addressee will readily appreciate that any other suitable number of motors 115 may be used.

The lower surface 105*a* is configured to be placed flush against the concrete, and as such, may be prone to wear. In some embodiments, the lower surface 105*a* is separable from the rest of the body and may comprise durable plastic, which may be replaced, as needed. In such case, the lower surface 105*a* may be releasably attached to the base 105 by the vibrating plates 120.

The handles 110 include a throttle or a switch enabling a user of the vibrating float to control operation of the vibrating float 100. In some embodiments, the throttle enables the user to control a speed of the motors 115, and thus a frequency of vibration, through manipulation of the throttle. In other embodiments, the user is able to turn on or off the motors 115 using the switch. Either way, the user is able to turn on or off the motors without having to substantially change position.

While the term throttle is used, the skilled addressee will readily appreciate that no true throttle (in the traditional sense of throttling air to a combustion engine) is provided, but instead the throttle controls a speed and/or amplitude of vibration in the motors 115.

The body 105 is substantially triangular (wedge shaped) cross section, with a point of the wedge 105*b* facing forwards, and a substantially vertical wall 105*c* facing rearwards. As such, the body 105 is particularly configured to level concrete as moved forward over the concrete. The skilled addressee will, however, readily appreciate that the body may be moved over the concrete in any direction, including forwards, rearwards, and diagonally across the concrete.

The vibrating float 100 further includes a removable battery 125, for powering the vibrating float 100 and in particular the motors 115. The removable battery 125 may be recharged separate to the vibrating float 100, which enables multiple batteries to be used in a large job (i.e. where one battery is being used while another battery is being recharged).

According to certain embodiments, a control panel (not illustrated) is provided on the vibrating float 100, which enables the user to adjust a speed, frequency or pattern of speed/frequency of the vibrating float 100. Depending on the concrete composition, or other factors, such as desired finish, operator preferences or the like, it can be desirable to operate the vibrating float 100 at different settings. In such case, the control panel may be used to set base parameters (e.g. max speed, vibrating frequency), and the throttle may be used to operate the vibrating float 100 within those parameters.

Figure 3:
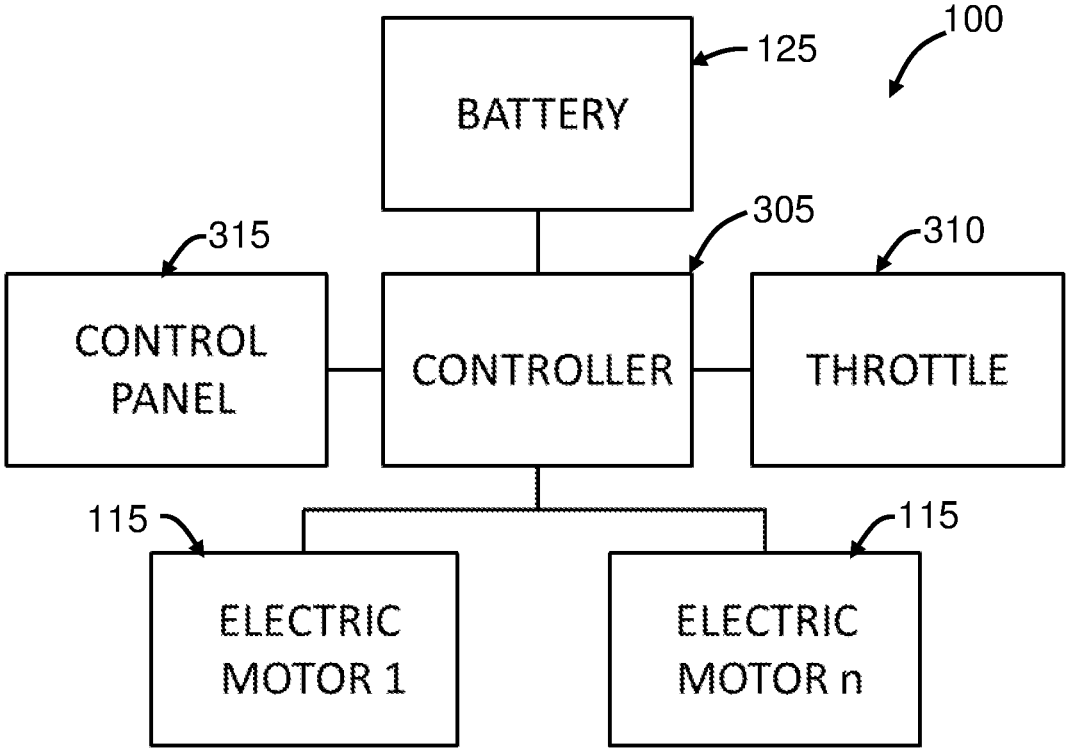
FIG. 3 illustrates a schematic of the float of FIG. 1, according to an embodiment of the present invention.

FIG. 3 illustrates a schematic of the vibrating float 100, according to an embodiment of the present invention. The vibrating float 100 includes a controller 305, which is coupled to the battery 125, the throttle 310, the electric motors 115 and the control panel 315. The controller 305 receives a signal from the throttle 310, and controls the electric motors at least part based thereon.

As mentioned earlier, the control panel 315 may be used to input base parameters (such as frequency) of the motors 115, and in such case the controller 305 controls the motors according to the throttle signal and data input using the control panel 315.

The controller may comprise a microprocessor and memory, which are configured to receive and process data from the throttle 310 and/or control panel 315, together with predefined operating parameters on the memory.

Figure 4:
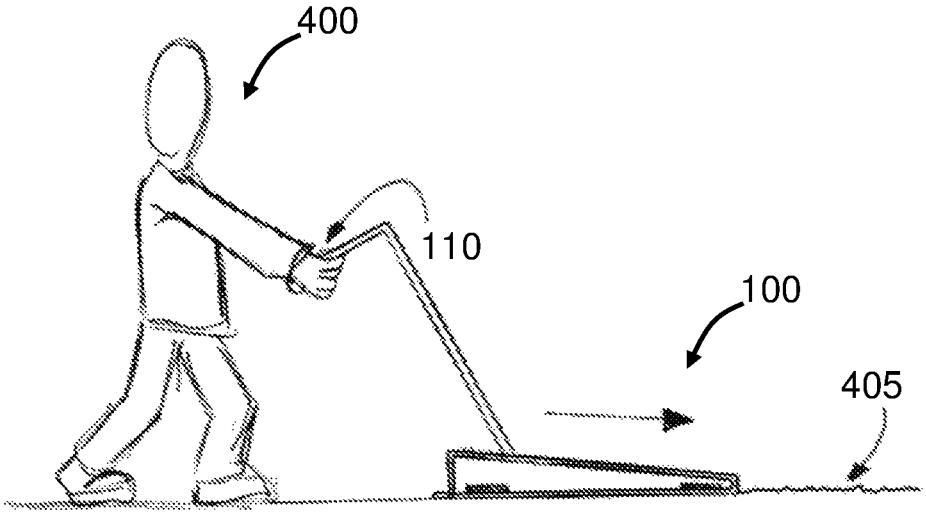
FIG. 4 illustrates the vibrating float of FIG. 1, in use by a user.

FIG. 4 illustrates the vibrating float 100 in use by a user 400. In short, the user 400 manoeuvres the vibrating float 100 forwards over uneven concrete 405 to smoothen and level the concrete. As the vibrating float 100 vibrates, it also compacts the concrete, and acts to assist the vibrating float 100 in "floating" across the concrete, thus requiring less work by the user 400 to control movement of the vibrating float 100.

Ends of the handle 110 are about waist height, which enables the user to walk forward in a safe and comfortable posture, while controlling the vibrating float 100.

The elongate body 105 is preferably about 2.8 to 3 meters long, and at least about 100 millimetres wide.

The vibrating float 100 is ergonomic, and provides a safe and convenient way to level concrete, which in turn prevents stress and injury to the lower body, knees and back. Furthermore, the vibrating float 100 is lightweight, and can thus can be safely moved and transported by a single person.

As the motors 115 are placed along a length of the body 105, even vibration is provided. This enables relatively small motors to be used, as vibration is not lost along a length of the body 105. This may in turn reduce vibration being transferred to the user.

The vibrating float 100 is also robust, and the lower surface 105*a* may function as a wear plate, which can be replaced as required.

Finally, as the vibrating float 100 can be used with multiple batteries, indefinite operating time can be provided as batteries can be swapped on rotation and charged.

Figure 5:
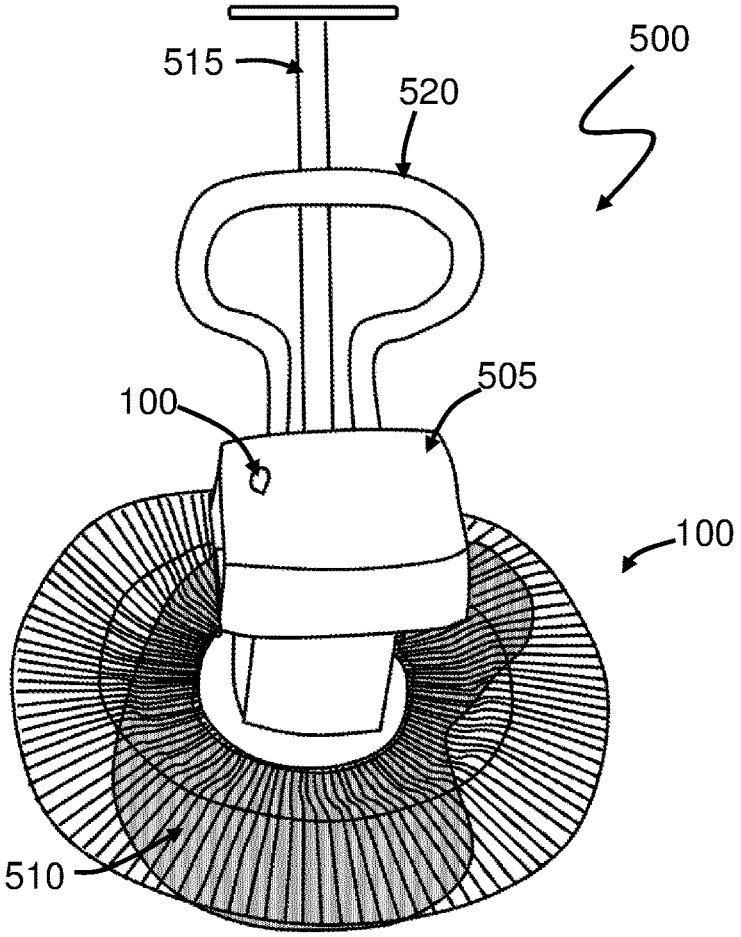
FIG. 5 illustrates a front perspective view of a rotary trowel, according to an embodiment of the present invention.

FIG. 5 illustrates a front perspective view of a rotary trowel 500, according to an embodiment of the present invention. The rotary trowel 500 is ergonomic, and provides a safe and convenient way to trowel concrete while standing, which prevents stress and injury to the lower body, knees and back. Furthermore, the rotary trowel 500 is lightweight, and can thus can be safely moved and transported by a single person.

The rotary trowel 500 includes a body 505, in which an electric motor (not illustrated) is housed, which is configured to spin a blade 510. In particular, the blade is spun across semi-hardened concrete to provide a smooth finish to the concrete.

The blade 510 is kidney-shaped, and is slightly curved upwards at leading edges (i.e. in the direction of rotation) to prevent the blade from accidently digging into and damaging the concrete.

A control arm 515 extends upwardly and outwardly from the body 505, and is configured to allow a user to manipulate the rotary trowel 500 across a bed of semi-hardened concrete to smoothen (or polish) the concrete, while retaining an ergonomic posture.

The control arm 515 is releasably engageable with the body 505 by a handle assembly 520. As such, the control arm 515 can be removed to simplify transportation of the rotary trowel 500. The handle assembly 520 also functions to enable the user to lift the rotary trowel 500.

Figure 6:
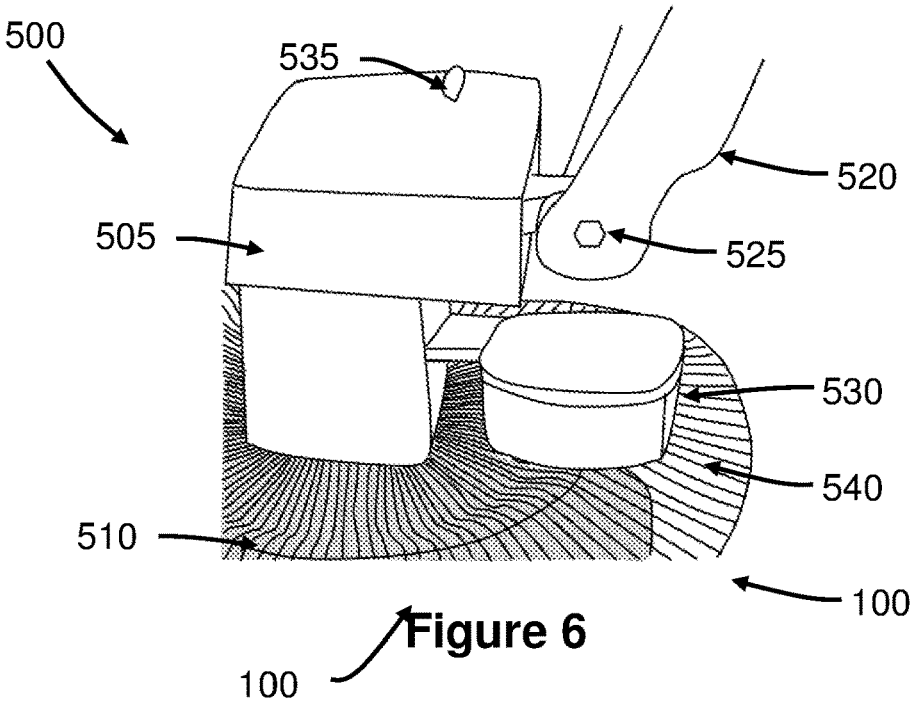
FIG. 6 illustrates a side perspective view of a portion of the rotary trowel of FIG. 5.

As best illustrated in FIG. 6, the handle assembly 520 is adjustable by a pivot hinge. In particular, the handle assembly 520 can rotate upwards and downwards relative to the body 505, which in turn causes the control arm 515 to move up and down. As such, the user is able to adjust a height of the control arm 515 such that in use, ends of the control arm 515 are at about waist height, which enables safe and ergonomic use of the rotary trowel 500.

The control arm 515 includes, or is coupled to, a throttle or a switch enabling a user of the vibrating float to control operation of the vibrating float 100 from an operating position. The throttle may enable the user to control a speed of the motor, or the user may be able to turn on or off the motors using the switch.

The body further includes a master switch 535, for enabling the user to turn on or off the rotary trowel 500. The master switch 535 may prevent the rotary trowel 500 from accidently engaging when not in use.

The rotary trowel 500 further includes a removable battery 530, for powering the rotary trowel 500 and in particular the motor. The removable battery 530 may be recharged separate to the rotary trowel 500, which enables multiple batteries to be used in a large job, as discussed above with reference to the vibrating float.

According to certain embodiments, a control panel (not illustrated) is provided on the rotary trowel 500, as described above with reference to the vibrating float 100. The control panel enables the user to adjust a speed of the rotary trowel 500, depending on the concrete composition, or other factors, such as desired finish, hardness of the concrete, operator preferences or the like. The control panel may be used to set base parameters (e.g. max speed), and the throttle may be used to operate the rotary trowel 500 within those parameters.

Finally, the rotary trowel 500 includes a shield 540, for shielding the blade 510. The shield 540 is particularly important from a safety perspective, in that it may prevent loose clothing and the like from being caught in the blade 510.

Figure 7:
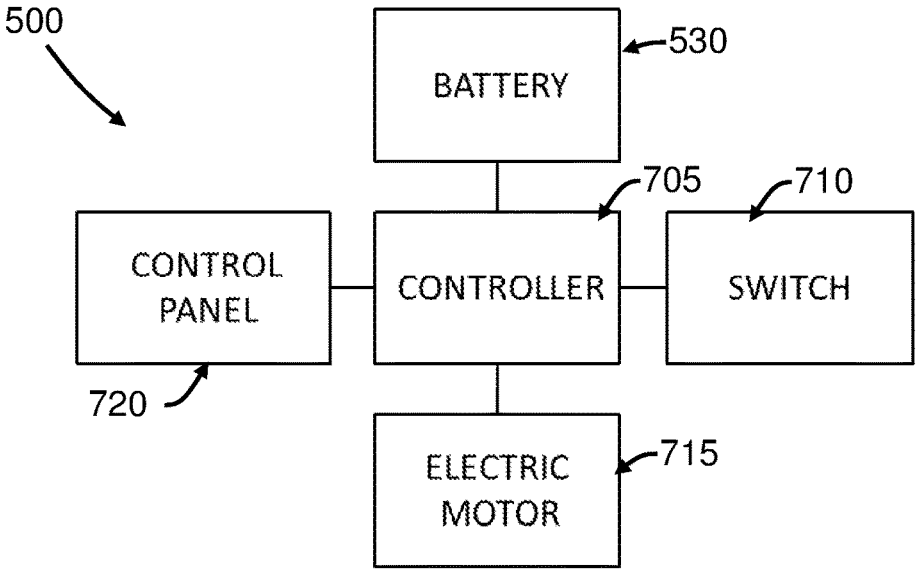
FIG. 7 illustrates a schematic of the rotary trowel of FIG. 5, according to an embodiment of the present invention.

FIG. 7 illustrates a schematic of the rotary trowel 500, according to an embodiment of the present invention. The rotary trowel 500 includes a controller 705, which is coupled to the battery 530, the switch 710, the electric motors 715 and the control panel 720. The controller 705 controls the electric motor 715 at least in part based upon the switch 710 (which may comprise the master switch and a switch or throttle on the control arm 515).

The control panel 720 may be used to input base parameters (such as speed) of the motor 715, and in such case the controller 705 controls the motors according to the throttle signal (or switch position) and data input using the control panel 720.

The controller 705 may comprise a microprocessor and memory, which are configured to receive and process data from the switch 710 and/or control panel 720, together with predefined operating parameters on the memory.

Figure 8:
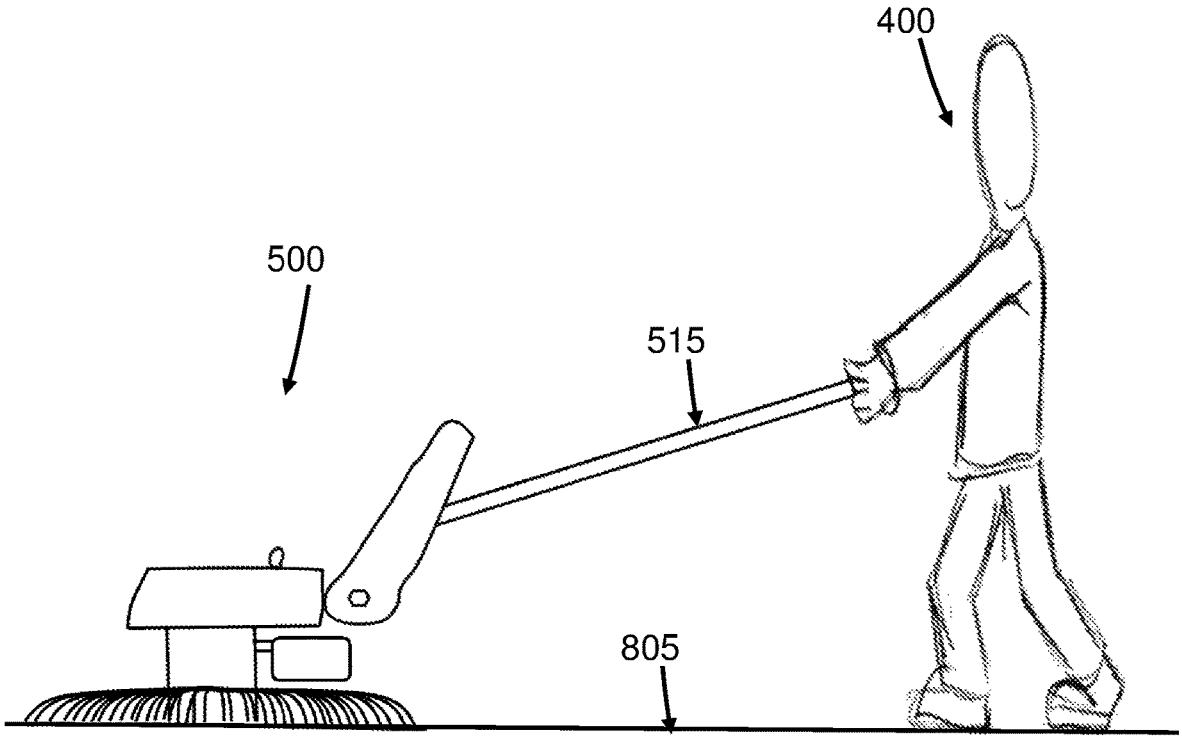
FIG. 8 illustrates the rotary trowel of FIG. 5, in use by the user.

FIG. 8 illustrates the rotary trowel 500 in use by the user 400. In short, the user 400 manoeuvres the rotary trowel 500 forwards over semi-hardened concrete 805 to smoothen and level the concrete. As the blade 510 of the rotary trowel 500 spins, it not only finishes (polishes) the concrete, but also assists the trowel 500 in "floating" across the concrete, thus requiring less work by the user 400 to control movement of the rotary trowel 500.

An end of the control arm 515 may be adjusted to about waist height, which enables the user 400 to operate the rotary trowel 500 in a safe and comfortable posture, while controlling the vibrating float 100.

The rotary trowel 500 is ergonomic, and provides a safe and convenient way to finish concrete, which in turn prevents stress and injury to the lower body, knees and back. Furthermore, the rotary trowel 500 is lightweight, and can thus can be safely moved and transported by a single person.

As the rotary trowel 500 can be used with multiple batteries, indefinite operating time can be provided as batteries can be swapped on rotation and charged.

Figure 9:
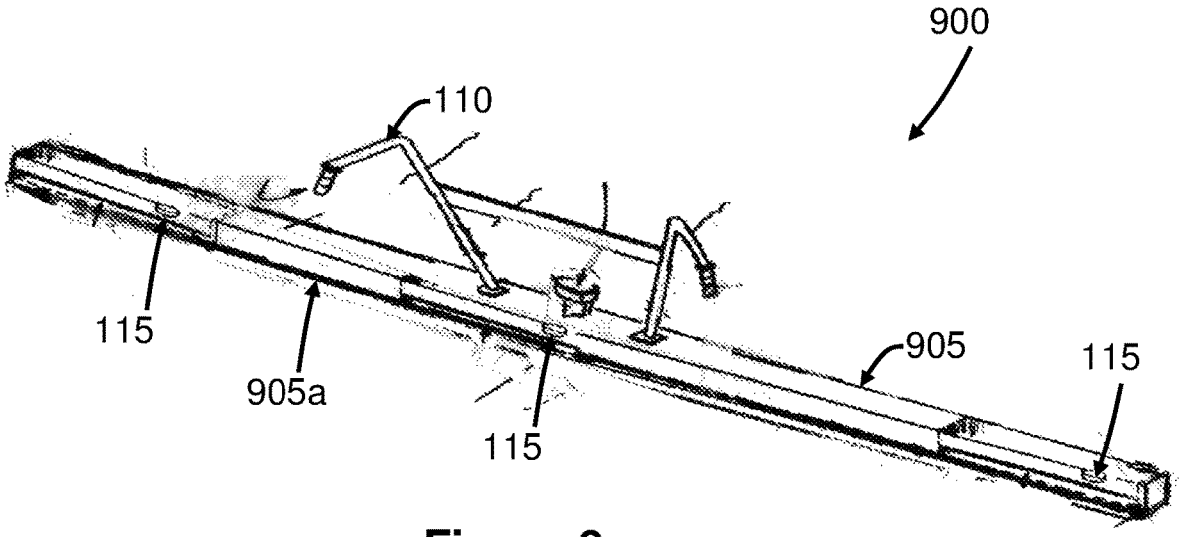
FIG. 9 illustrates a rear perspective view of a vibrating float, according to an alternative embodiment of the present invention.

FIG. 9 illustrates a rear perspective view of a vibrating float 900, according to an embodiment of the present invention. The vibrating float 900 is similar to the float 100, but with a thinner body, as outlined below.

The vibrating float 900 includes an elongate body 905, from which a pair of handles 110 upwardly extend. In use, ends of the handles 110 are at about waist height, much like the handles of the float 100, to enable the user to retain an ergonomic posture.

The body 905 defines a housing, which houses a plurality of electric motors 115. The electric motors 115 are coupled to a vibrating plate, which is in turn coupled to, and configured to vibrate a lower surface 905*a* of the body 905. The vibrating plate extends substantially across an entire length of the elongate body 905, and the electric motors 115 are placed along a length of the vibrating plate. As discussed above, such configuration provides vibration along an entire length of the body 905 with relatively small motors 115.

In the vibrating float 900, three vibrating motors 115 are evenly spaced along the length of the vibrating plate, but the skilled addressee will readily appreciate that any other suitable number of motors 115 may be used.

The vibrating float 900 includes a removable battery 125, for powering the vibrating float 900 and in particular the motors 115, as described above. Finally, the vibrating float may include a control panel (not illustrated) to enable the user to adjust a speed, frequency or pattern of speed/frequency of the vibrating float 900, as described above.

Figure 10:
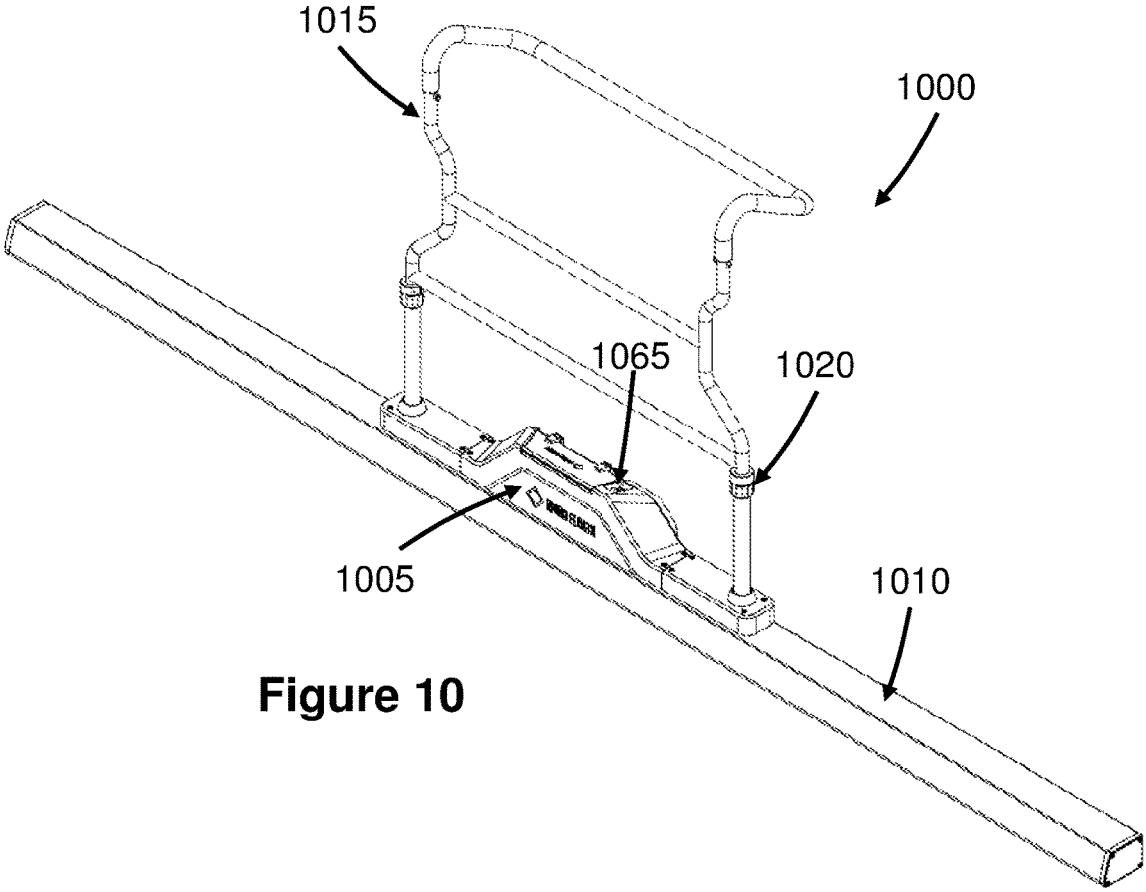
FIG. 10 illustrates a front perspective view of a vibrating float, according to an embodiment of the present invention.
Figure 11:
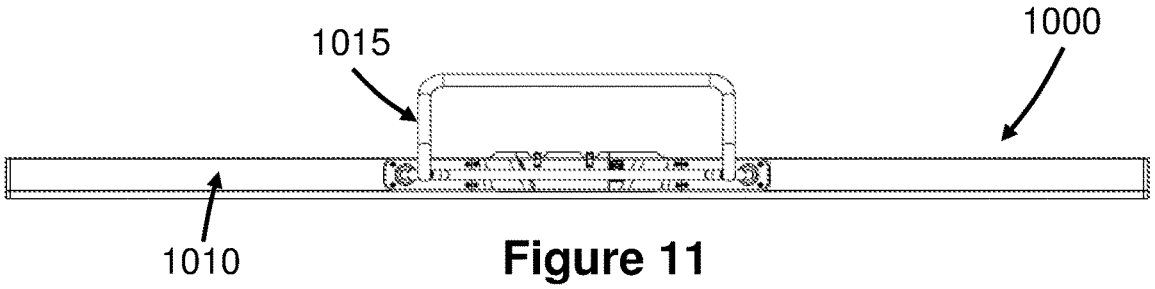
FIG. 11 illustrates a top view of the float of FIG. 10.
Figure 12:
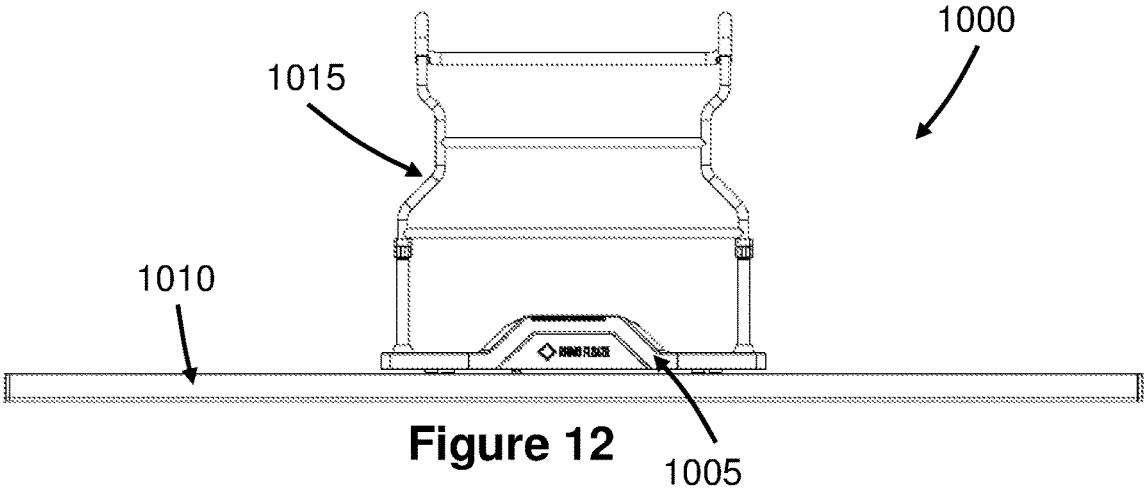
FIG. 12 illustrates a front view of the float of FIG. 10.
Figure 13:
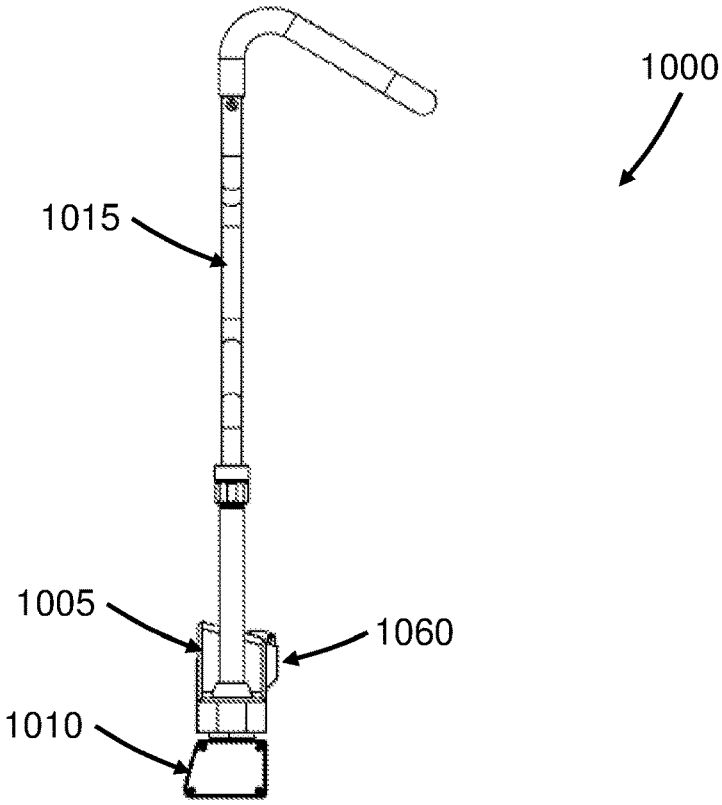
FIG. 13 illustrates a side view of the float of FIG. 10.

FIG. 10 illustrates a front perspective view of a vibrating float 1000, according to an embodiment of the present invention. The vibrating float 1000 is similar to the float 100, as outlined below. FIG. 11 illustrates a top view of the float, FIG. 12 illustrates a front view of the float, and FIG. 13 illustrates a side view of the float.

The vibrating float 1000 includes a body 1005 mounted on an elongate screed portion 1010, and handles 1015 that extend upward from the body 1005. The handles 1015 include an adjustment member 1020, which enables the handles to be adjusted to a suitable height, which may be around waist height of the user, to enable the user to retain an ergonomic posture. The width of the handles 1015 also enables the user to easily control of the vibrating float 1000.

Figure 14:
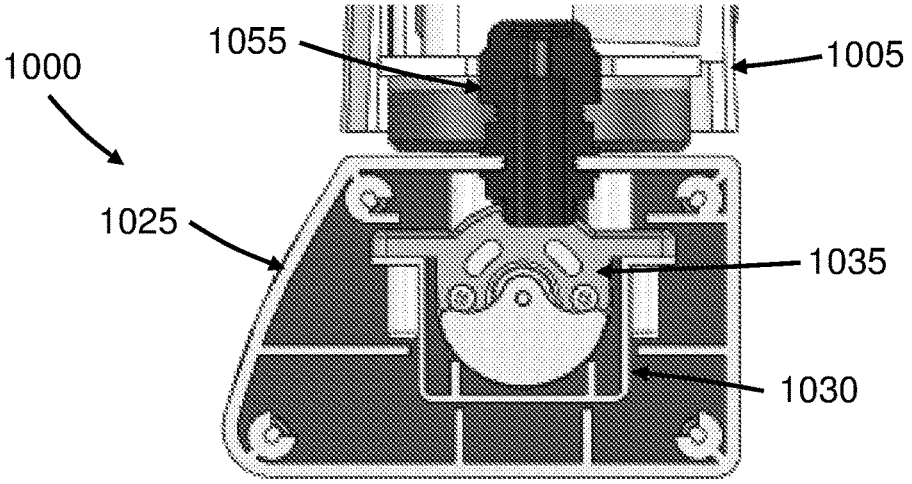
FIG. 14 illustrates a cross-sectional view a portion of the float of FIG. 10.
Figure 15:
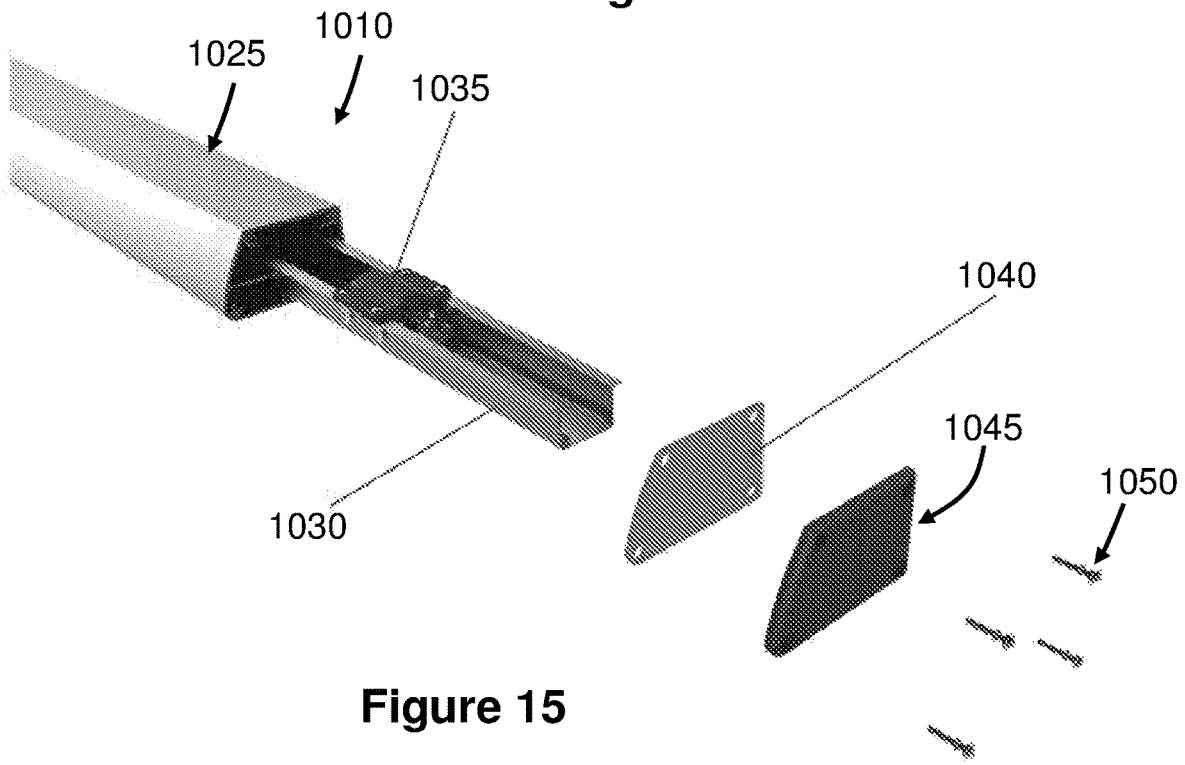
FIG. 15 illustrates an exploded perspective view of an elongate screed portion of the float of FIG. 10.

FIG. 14 illustrates a cross-sectional view a portion of the vibrating float 1000 and FIG. 15 illustrates an exploded perspective view of the elongate screed portion 1010.

The screed portion 1010 comprises an external frame 1025, which houses an elongate internal chassis 1030, along which a plurality of motors 1035 are secured. The motors 1035 are secured to the internal chassis 1030 by a screw clamp bracket.

The external frame 1025, which is of uniform cross section, receives the internal chassis 1030, which is also if uniform cross section, along an axis thereof. The external frame 1025 and the internal chassis 1030 may be extruded.

The motors 1035 may be periodically placed along a length of the chassis 1030, as outlined above in relation to the float 100. Outer ends of the screed portion 1010 are sealed using a rubber gasket 1040, an end cap 1045 screws 1050.

As best illustrated in FIG. 14, vibration mounts 1055 are placed between the screed portion 1010 and the body 1005 to reduce the amount of vibration that is transferred to the body and thus the to the user through the handles 1015.

Turning back to FIG. 13, the body 1005 is configured to receive a rechargeable battery 1060, which is removable, e.g. for charging. The body 1005 may include a cover to protect the battery when in use.

The body 1005 further includes a power switch, for powering the vibrating float 1000 on or off. Advantageously, the switch comprises a two-speed switch, to enable the vibrating float 1000 to operate at different speeds.

While the above has been described with levelling and finishing concrete, the skilled addressee will readily appreciate that tools according to the invention may be suited to other purposes, such as settling and/or compacting concrete, or providing a particular finish or pattern to concrete.

In the present specification and claims (if any), the word 'comprising' and its derivatives including 'comprises' and 'comprise' include each of the stated integers but does not exclude the inclusion of one or more further integers.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

The invention claimed is:

1. A vibrating float for levelling concrete, the vibrating float comprising:

an elongate body having a first length and a lower surface;

an elongate plate, having a second length and a substantially planar lower surface configured to be moved across and in contact with the concrete, the elongate plate comprising the lower surface of the elongate body;

a plurality of electric motors coupled to and evenly spaced along the second length of the elongate plate and configured to vibrate the elongate plate along the first length of the elongate body;

an elongate internal chassis received within the elongate body, the plurality of motors coupled to the elongate chassis; and a pair of handles, coupled to the elongate plate, for use by an operator to control movement of the vibrating float.

2. The vibrating float of claim 1 including a first plurality of motors along a front edge of the elongate plate, and a second plurality of motors along a rear edge of the elongate plate.

3. The vibrating float of claim 1 wherein the plurality of motors are centrally positioned along the length of the elongate plate.

4. The vibrating float of claim 1 wherein the elongate body and chassis are uniform in cross section.

5. The vibrating float of claim 1, wherein the elongate body is configured to receive end caps to retain the chassis therein.

6. The vibrating float of claim 1, including one or more spacers extending between the pair of handles.

7. The vibrating float of claim 1 wherein the pair of handles extend handle upwardly in a direction perpendicular to the lower surface of the elongate plate, then backwards.

8. The vibrating float of claim 1 wherein the pair of handles includes a throttle enabling the user to control a speed of the motor, and thus a frequency of vibration.

9. The vibrating float of claim 1 wherein the pair of handle are adjustable in height.

10. The vibrating float of claim 1 including a control panel, to enables an operator to adjust a speed or frequency of the vibrating float.

11. The vibrating float of claim 1 comprising a dampener between the elongate plate and the handle, the dampener configured to reduce an amount of vibration from the elongate plate in the handle.

12. The vibrating float of claim 1 wherein the elongate body includes a slanted wall facing forwards, and a substantially vertical wall facing rearwards.

13. The vibrating float of claim 1 including a rechargeable battery, coupled to the at least one electric motor, configured to power the electric motor.

14. The vibrating float of claim 13 wherein the rechargeable battery is removable from the vibrating float for charging.

* * * * *